United States Patent [19]

Looper

[11] Patent Number: 4,943,096

[45] Date of Patent: Jul. 24, 1990

[54] WINDOW LOCK APPARATUS

[76] Inventor: William C. Looper, 935 Highland Mist La., Charlotte, N.C. 28215

[21] Appl. No.: 409,911

[22] Filed: Sep. 19, 1989

[51] Int. Cl.[5] ..... F05C 3/04

[52] U.S. Cl. ..... 292/213; 292/DIG. 47; 292/283; 292/DIG. 20

[58] Field of Search ..... 292/DIG. 20, DIG. 47, 292/DIG. 9, 213, 283, 284, 207, 262, 265, 266, 269, 273, 277

[56] References Cited

U.S. PATENT DOCUMENTS

| | | | |
|---|---|---|---|
| 730,266 | 6/1903 | Hoyt | 292/283 |
| 765,172 | 7/1904 | Essig | 292/DIG. 20 |
| 1,315,568 | 9/1919 | Nelohammer | 292/283 |
| 1,471,177 | 10/1923 | Lyon | 292/207 |
| 1,492,768 | 5/1924 | Wallen | 292/207 |
| 1,834,678 | 12/1931 | Bryant | 292/283 |
| 1,938,258 | 12/1933 | Luneburg | 292/DIG. 20 |
| 2,392,906 | 1/1946 | Doyle | 292/283 |
| 2,504,367 | 4/1950 | Willink | 292/278 |
| 2,652,276 | 9/1953 | Cole | 292/DIG. 20 |
| 3,135,543 | 6/1964 | Ingalls | 292/262 |
| 3,591,219 | 7/1971 | Graziosi | 292/207 |
| 4,042,265 | 8/1977 | Chezem | 292/262 |
| 4,062,578 | 12/1977 | Chen | 292/262 |

FOREIGN PATENT DOCUMENTS

| | | | |
|---|---|---|---|
| 741665 | 12/1955 | United Kingdom | 292/283 |

*Primary Examiner*—Eric K. Nicholson

*Attorney, Agent, or Firm*—Henderson & Sturm

[57] ABSTRACT

A lock apparatus (10) for immobilizing a lower window sash (101) relative to a window sill (102) wherein the apparatus (10) comprises a pivoted bracket element (18) and a stationary bracket element (21) attached to the window sill (102) and window sash (101) and having aligned latch elements (19) and (22) which are dimensioned to receive an elongated bolt member (30) to lock the window sash (101) relative to the window sill (102).

3 Claims, 1 Drawing Sheet

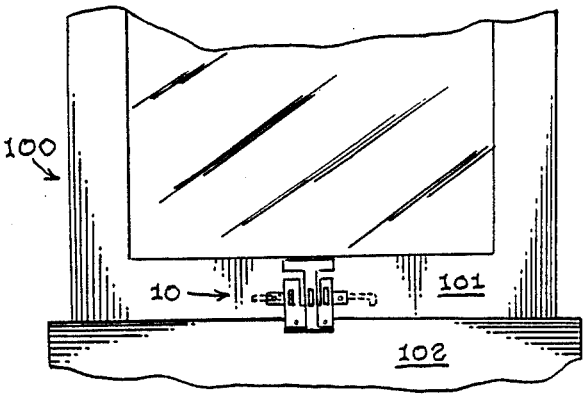
FIG. 1.
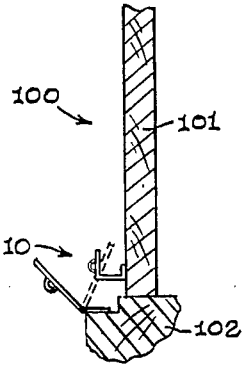
FIG. 2.
FIG. 3.
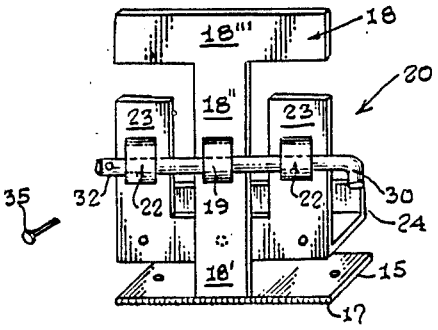
FIG. 4.
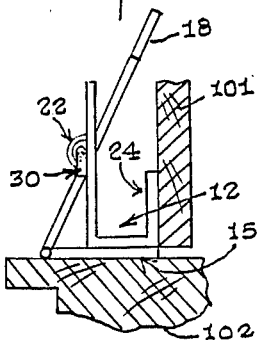
FIG. 5.
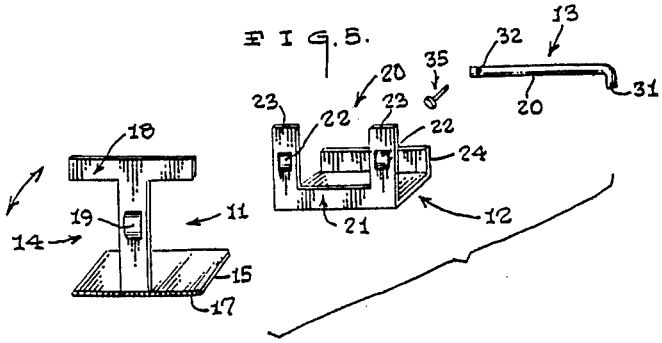

WINDOW LOCK APPARATUS

TECHNICAL FIELD

The present invention relates generally to the field of window lock devices, and more particularly to a bolt actuated window lock apparatus.

BACKGROUND OF THE INVENTION

This invention was the subject matter of Document Disclosure Program Registration No. 212,576 which was filed in the U.S. Patent and Trademark Office on Oct. 18, 1988.

As can be seen by reference to the following U.S. Pat. Nos.: 2,504,367; 3,135,543; 4,042,265; and, 4,062,578 the prior art is replete with myriad and diverse window and door latching and locking devices.

While all of the aforementioned prior art devices are more than adequate for the basic purpose and function for which they have been specifically designed, these patented constructions also contain a number of both shared and individual shortcomings in their design and operation.

To begin with, while some of the aforementioned patented structures employ hinged cooperating structural elements, these hinged elements will allow limited displacement of the closure components prior to the locking engagement between the cooperating components; whereupon, the components have to be returned to their fully closed relationship before the components can be operatively disengaged from one another.

In addition, in the non-pivoted versions elongated spacer elements have to be employed in combination with the more conventional window closure arrangements in order to maintain the window pane segments in a fixed relationship relative to one another.

Furthermore, none of the above mentioned prior art references employ a bolt mechanism to effect the locking engagement between the window sill and the lower window framework to provide both a positive locking arrangement while the bolt is engaged with the locking components, while allowing the operative disengagement between the cooperating components by removal of the bolt such that the window can be easily opened.

As a consequence of the foregoing situation there has existed a longstanding need among users of window latching devices for a safe and secure bolt actuated window locking apparatus wherein the presence of the bolt provides a secure locking arrangement and the absence of the bolt allows the window to be quickly opened in the normal manner; and, the provision of such a device is a stated objective of the present invention.

SUMMARY OF THE INVENTION

Briefly stated, the window lock apparatus that forms the basis of the present invention comprises a pivoted unit; a stationary unit; and, a bolt unit which are used to immobilize the lower window sash relative to the window sill.

As will be explained in greater detail further on in the specification in the preferred embodiment of this invention the pivoted unit is intended to be operatively engaged with the window sill and comprises a pivoted bracket member having a base portion affixed to the window sill and attached to a pivoted bracket element having a single latch element.

As a consequence, the stationary unit is intended to be affixed to the lower portion of the bottom window sash and comprises a stationary bracket member having a pair of latch elements which can be aligned with the single latch element on the pivoted bracket element of the pivoted unit.

In addition, the bolt unit comprises an elongated bolt member that is dimensioned to be received in the aligned latch elements in the stationary unit and the pivoted unit to immobilize the lower window ° ash relative to the window sill; wherein, the bolt member may be optionally provided with a locking means for preventing the withdrawal of the bolt member relative to the aligned latch elements.

BRIEF DESCRIPTION OF THE DRAWINGS

These and other objects, advantages, and novel features of the invention will become apparent from the detailed description of the best mode for carrying out the preferred embodiment of the invention which follows; particularly when considered in conjunction with the accompanying drawings, wherein:

FIG. 1 is a front plan view of the locking apparatus installed on a window assembly in the locked disposition;

FIG. 2 is a side elevation view of the apparatus in the open disposition;

FIG. 3 is an isolated perspective view of the apparatus in the closed,, disposition;

FIG. 4 is an isolated side view of the apparatus in the closed disposition; and, FIG. 5 is an exploded perspective view of the apparatus.

BEST MODE FOR CARRYING OUT THE INVENTION

As can be seen by reference to the drawings and in particular to FIG. 5, the window lock apparatus that forms the basis of the present invention is designated generally by the reference numeral (10). The apparatus (10) comprises in general: a pivoted unit (11); a stationary unit (12); and, a bolt unit (13). These units will now be described in seriatim fashion.

Prior to embarking upon a detailed description of the preferred embodiment of the apparatus (10) it would first be advisable to briefly review the specific environment in which the apparatus (10) is to be employed. As shown in FIGS. 1 and 2, the environment is designated generally as (100) and comprises a lower window sash (101) and a window sill (102).

As can best be seen by reference to FIGS. 3 and 5, the pivoted unit (11) comprises a pivoted bracket member (14) having a base portion (15) that is adapted to be secured to the window sill (102); wherein, the base portion (15) is pivotally attached as at (17) to a bracket element (18) having a single latch element (19) formed thereon. In addition, the pivoted bracket element (18) is provided with a generally T-shaped configuration; wherein the stem (18') of the pivoted bracket element (18) is pivotally secured to the base portion (17) and the top cross-piece (18'') is rigidly connected to the stem (18') which is provided with the single latch element (19).

The stationary unit (12) comprises a rigid bracket member (20) having an enlarged generally U-shaped vertical face panel (21) forming a pair of arms (23) provided with aligned latch elements (22). In addition, the bottom of the face panel (21) is rigidly secured to one end of a horizontal plate element (25); wherein, the other end of horizontal plate element (25) is provided with a vertical mounting flange (24); such that the rigid bracket member (20) has a generally L-shaped configuration when viewed from the side.

In addition, as can best be appreciated by reference to FIG. 4, the vertical mounting flange (24) is adapted to be fastened to the window sash (101) such that the vertical face panel (21) will be disposed at a distance from the window sash (101).

As can best be seen by reference to FIGS. 3 thru 5, the bolt unit (13) comprises an elongated bolt member (30) having a handle portion (31) formed on one end and an optional aperture (32) formed on the other end; wherein the elongated bolt member is dimensioned to be received in and extend beyond the latch elements (19) and (22) to operatively engage the pivoted unit (11) to the stationary unit (12) as depicted in FIGS. 3 and 4; wherein, the window sash (101) will be locked relative to the window sill (102) in a well recognized manner.

It should also be mentioned at this juncture that the aperture (32) that is formed proximate one end of the bolt member (30) is provided to receive a suitably dimensioned locking pin (35) that extends through the bolt member (30) transverse to the direction of travel of the bolt member (30) relative to the latch elements (19) and (22) to prevent the bolt member (30) from being inadvertently disengaged from the latch elements (19) and (22) while in the locked disposition.

Turning now to FIGS. 3 and 4, it should be appreciated that when the user desires to engage but not lock the apparatus (10), the bolt unit (13) is withdrawn with the pivoted unit (11) disposed in the orientation depicted in FIG. 4. Now when the window sash (101) is moved upwardly; a limited amount (approximately two inches) of vertical travel will be permitted between the sash (101) and the sill (100); until the cross-piece (18″) of the pivoted bracket element (18) engages the face panel (21) of the rigid bracket member (20); wherein, the arms (23) of the face panel (21) prevent the pivoted bracket element (18) from being pivoted in a counterclockwise direction until such time as the window sash (101) returns into contact with the window sill (100).

It should also be appreciated at this juncture that the top (18″) of the pivoted bracket element (18) also serves as a handle for flipping the pivoted bracket element into and out of the upright bolt engaging orientation of the apparatus (10); however, it's main purpose is to prevent the window from being raised no more than two inches should the bolt member (30) not be engaged to allow for ventilation while also maintaining security.

Having thereby described the subject matter of this invention it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A window lock apparatus for locking a lower window sash relative to a window sill wherein the apparatus comprises:

a pivoted bracket member having a base portion that is operatively engaged with one of said window sill and window sash; wherein, said base portion is pivotally attached to a pivoted bracket element provided with a latch element; wherein the pivoted bracket element has a generally T-shaped configuration including a relatively elongated stem and a cross-arm and a single latch element is formed on the stem of the pivoted bracket element;

a stationary a bracket member operatively engaged with the other of said window sash and window sill; wherein the stationary bracket member is provided with at least one latch element; and, wherein the latch elements on said pivoted and said stationary bracket members are adapted to be brought into alignment with one another; wherein the stationary bracket member comprises a rigid bracket element having a pair of spaced and aligned latch elements and a generally U-shaped face panel forming arms wherein each one of the pair of aligned latch elements are disposed on each one of the arms of the bracket element respectively; and, wherein said rigid bracket element is further provided with: a horizontal plate attached on one end to the bottom of the face panel; and, a vertical mounting flange attached to the other end of said horizontal plate; and, an elongated bolt member dimensioned to be received in said latch elements in said stationary and pivoted bracket members to prevent relative movement between the window sill and the lower window sash; and, whereby the removal of said elongated bolt member from said latch elements allows the window sash to be raised relative to said window sill until such time that the cross arms on the T-shaped pivoted bracket element come into contact with the stationary bracket member such that the window sash may be raised in a releasable yet captive disposition relative to said window sill.

2. The apparatus as in claim 1 wherein the elongated bolt member is provided with a handle on one end.

3. The apparatus as in claim 2 wherein the bolt member is provided with a transverse aperture on the other end and a locking pin dimensioned to be received within the aperture to prevent the withdrawal of the bolt member relative to the aligned latch elements.

* * * * *